United States Patent [19]

Bennett, Jr.

[11] Patent Number: 4,674,249

[45] Date of Patent: Jun. 23, 1987

[54] ROOFING AND DECKING CONSTRUCTION

[76] Inventor: Carveth W. Bennett, Jr., P.O. Box 711, Elon College, N.C. 27244

[21] Appl. No.: 776,619

[22] Filed: Sep. 16, 1985

[51] Int. Cl.[4] ..... E04B 1/70

[52] U.S. Cl. ..... 52/302; 52/408; 108/901; 108/51.1

[58] Field of Search ..... 52/199, 302, 303, 408, 52/263; 108/901, 51.1

[56] References Cited

U.S. PATENT DOCUMENTS

| | | | |
|---|---|---|---|
| 3,795,180 | 3/1974 | Larsen | 52/408 X |
| 4,060,037 | 11/1977 | Gustafsson | 108/51.1 |
| 4,189,886 | 2/1980 | Frohlich et al. | 52/302 |
| 4,397,126 | 8/1983 | Nelson | 52/302 X |
| 4,449,336 | 5/1984 | Kelly | 52/409 X |
| 4,490,952 | 1/1985 | Winston | 52/302 X |
| 4,534,119 | 8/1985 | Glicksman | 52/302 X |

FOREIGN PATENT DOCUMENTS 2021424 11/1970 Fed. Rep. of Germany ..... 108/901

*Primary Examiner*—William F. Pate, III
*Assistant Examiner*—Creighton Smith
*Attorney, Agent, or Firm*—Charles R. Rhodes; Judith E. Garmon

[57] ABSTRACT

An improved, ventilated roof construction for flat roof installations substantially decreases damage caused by roof leaks that allow water to settle into the roofing substratum and insulation. A grid or perforated plate is supported in spaced arrangement above the underlying roofing support deck and immediately beneath the exterior roofing surface to define an air passageway or air duct therein. The grid allows evaporation of moisture from the insulation layer therethrough as air circulates thereunder. A plurality of conduits leading from the grid to the exterior roofing surface provide means for vacuuming accumulated water from the interior roofing structure to avoid damage thereto, or to pump water into the interior roofing structure to extinguish fires.

7 Claims, 7 Drawing Figures

ROOFING AND DECKING CONSTRUCTION

BACKGROUND AND SUMMARY OF THE PRESENT INVENTION

The present invention is directed to flat roofing systems, and more particularly to a ventilating system for such roof systems. The primary components of a flat roof system are the roofing cover or membrane, the insulation layer, and the supporting deck. Various approaches have been taken to prevent leakage in these types of roofing systems, but little or nothing has been designed to remove or dissipate moisture which does happen to accumulate in the insulation layer of the roof.

It is relatively easy to ventilate a cold attic below a gabled residential roof because a large air space (i.e., the attic) is available. See U.S. Pat. Nos. 3,797,180 and 3,972,164. However, in compact roofs such as the built-up or flat-roof type, ventilation becomes far more difficult because little or no air space exists between the components. In most of these compact systems the roofing membrane is of a multi-layer type broadly including of a layer of insulating felt over a support deck, a layer of hot bituminous adhesive material mopped over the felt, and an aggregate material forming the exterior surface of the roof. An additional vapor barrier such as a layer of polyethylene may or may not be included between the felt and the underlying support deck. The vapor barrier inhibits the flow of vapor or moisture through the roofing system. For most buildings that are potentially problematic, vapor or moisture that enters a roof during the cold season is less of a problem when there is ample opportunity during the summer season to dry out.

In textile mills, carpet mills, and other highly humid facilities, however, the summer drying period may not be sufficient to overcome vapor accumulation in the roofing insulation. In the past, such humid facilities have been provided with highly efficient vapor barriers or retarders and/or supplementary venting devices. The venting devices do not provide for removal of accumulated moisture, but such provisions do improve air flow through the roof and help keep the insulation dry if the vapor retarder is adequate for the given conditions.

Where the ventilation and vapor retarding measures are insufficient to control the moisture problem and prevent moisture accumulation in the insulation layer, it is usually necessary to eventually strip away and replace the wet insulation and the roofing material in the damaged area. This is obviously an expensive procedure and to be avoided where possible.

Additionally, damage and destruction of roofing systems caused by fire have in the past been resolved by replacement of the damaged roof. Fire damage to the roof during the fighting of a fire can occur in at least two ways, and carpet and textile mills are among the most susceptible of facilities. The first way, of course, is the outbreak of fire followed by soaking of the roofing and insulation to extinguish or inhibit spread of the fire. A second common cause of damage is cutting or breaking of the roofing structure by firemen to control the fire. Where the roof is not burned or broken into, the roof system of the present invention becomes extremely important.

The minimizing of problems in moisture accumulation and the improvement of fire control in roofing structures are the problems confronted by the present invention.

Broadly described, the improved roofing system comprises a compact flat-roof system including a grid-type ventilation structure or means intermediate the supporting deck and the overlying insulation and composition membrane. The ventilation means provides for the movement of air between the layers of the roof structure and includes a grid member molded or otherwise formed from a plastic or metallic material.

The grid member is in the form of a planar configuration having a plurality of relatively large openings formed through the thickness thereof. The grid is supported on piers or legs atop the underlying supporting deck to provide for movement of air or vapor between the layers of the roofing structure. The grid sheets are provided in a variety of sizes from approximately 3'×8' to 9'×20', and of a thickness from 1" to 4" from bottom of foot to top of plate.

The grid member is supported on its legs or piers on the conventionally prepared deck and the sheets of insulation are placed thereover, followed by construction of the composition membrane. Thus positioned in the roofing structure, the grid member provides a substantially improved means for permitting air to flow through the roofing structure, thus improving the control of moisture accumulation in the insulation and roofing structure as a whole.

A further modification of the system includes the provision of a plurality of spaced apart, vertically extending vents or conduits opening to the exterior surface of the roof from a selected area of the grid ventilating means. These conduits, or vents, function as inlets or outlets for pumping water into the roofing system for fire extinguishing, or vacuuming accumulated water out of the roofing system to facilitate the drying of the insulation.

Other advantages to the use of the improved roofing system include: (1) roofing insulation is separated and isolated from water that enters the structure when the roofing membrane leaks; and (2) the air space gained through use of the grid member acts as additional thermal insulation. It is anticipated that other and further modifications will become apparent to those skilled in the art as the following detailed description is studied in conjunction with accompanying drawings, in which.

DETAILED DESCRIPTION OF A PREFERRED EMBODIMENT

Figure 1:
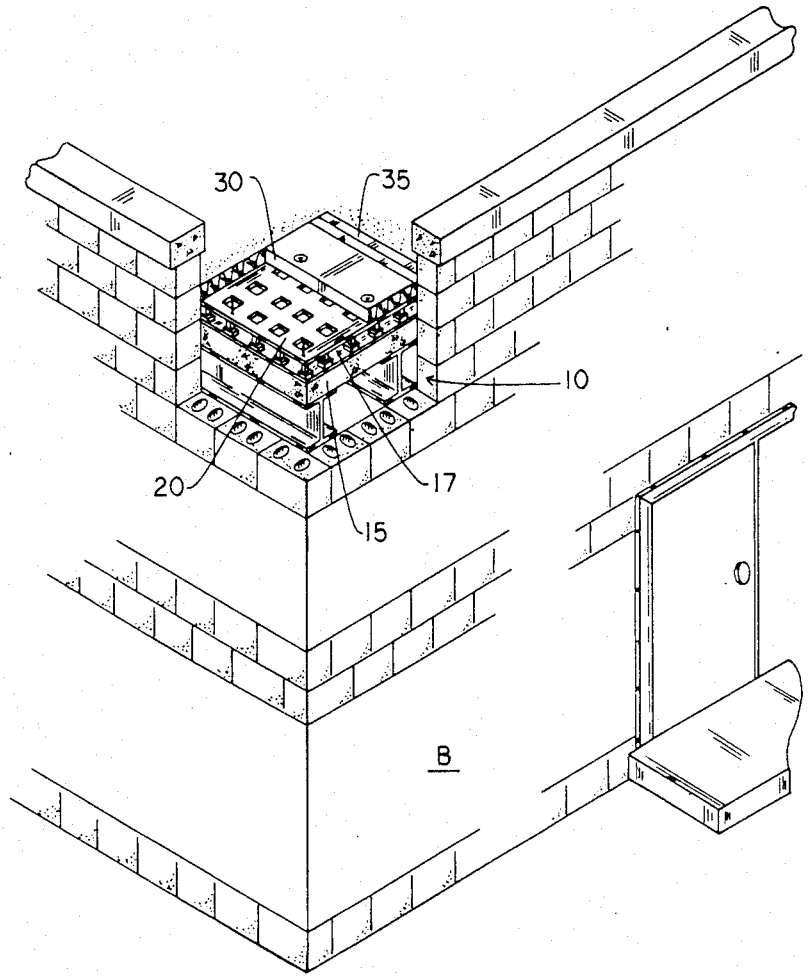
FIG. 1 is a perspective view, with parts broken away, of a building with a roofing construction according to a preferred embodiment of the present invention.

Looking first at FIG. 1, the illustrated building B is a commercial installation having a "flat roof" construction. The "built-up" or "flat-roof" roofing system 10 according to a preferred embodiment of the present invention includes a supporting deck 15; a layer of vapor retarding material 17 such as a variety of plastic membranes, composition sisal-Kraft, or composition built-up vapor retarders; the ventilating grid 20; insulating material 30; and the composition membrane covering 35.

Figure 2:
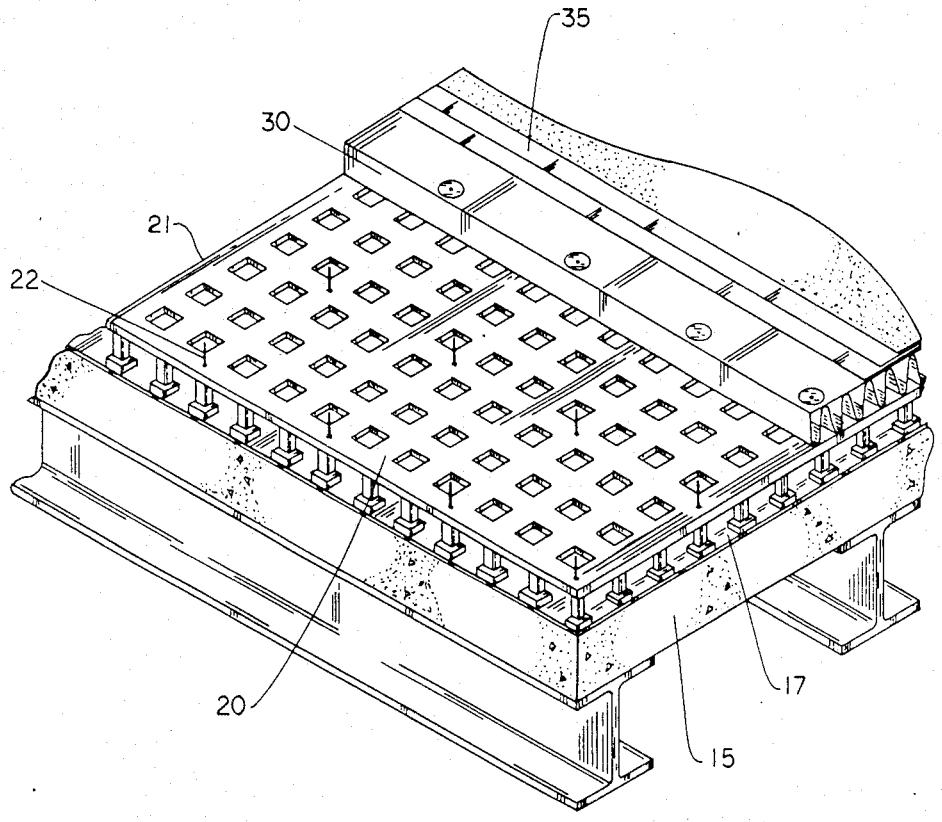
FIG. 2 is an enlarged perspective view of a portion of the roofing system of FIG. 1.
Figures 3, 3A:
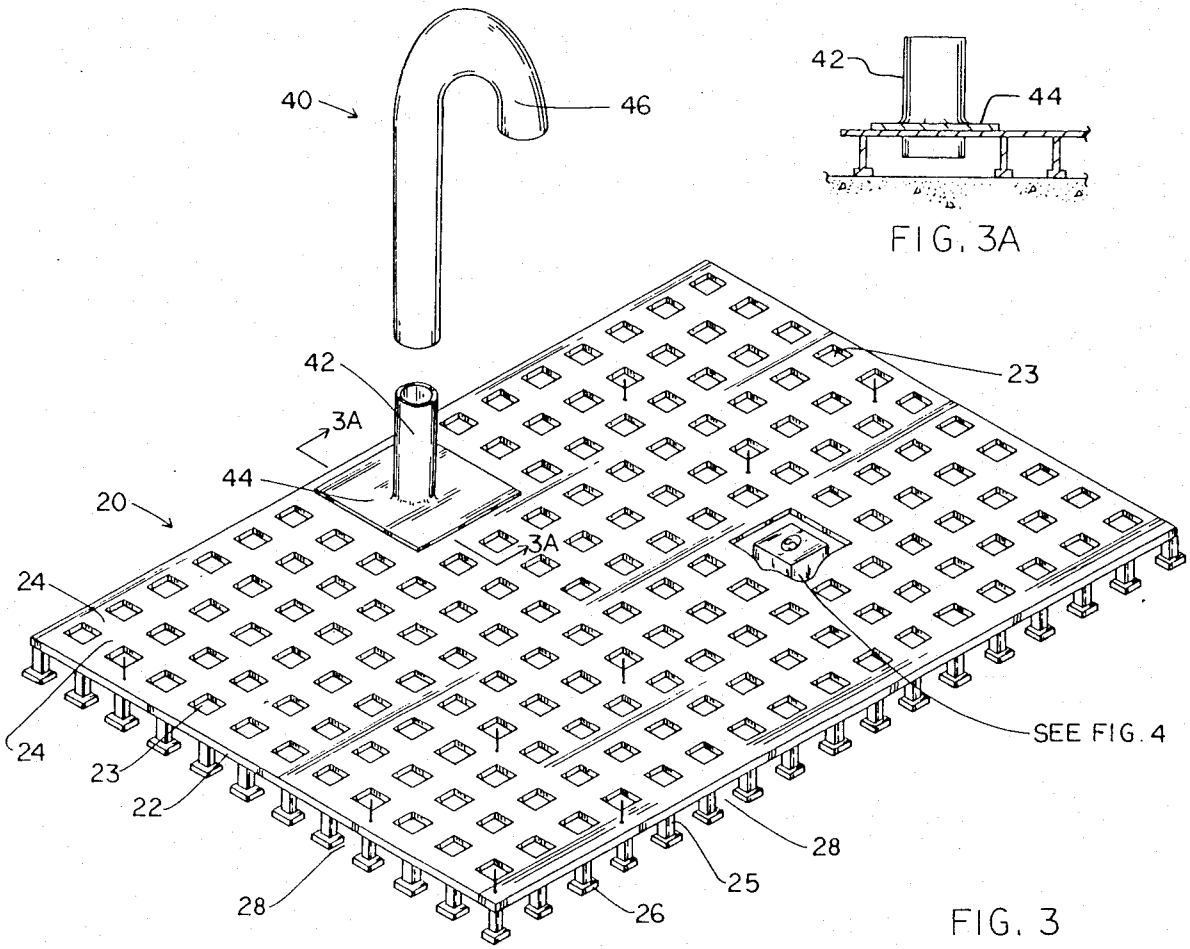
FIG. 3 is a perspective view of the grid member of the present invention alone and removed from the roofing system.

FIG. 2 illustrates the roof construction in more detail. The vapor retarding, insulating and composition elements 15, 17, 30, and 35 of the roof construction are conventional elements of such roofs and will not be discussed in detail herein. The ventilating grid 20, the manner of construction thereof, and the manner in which it interacts with the conventional elements are the heart of the present invention and will be discussed in greater detail hereinafter. The grid 20 is preferably formed from a sheet of molded, low density plastic material which reduces electrical conductance capacity and thus reduces hazardous conditions in the roofing system. Where electrical hazards are not a significant concern, or where other conditions so warrant, the grid 20 can be formed from lightweight metals and/or a variety of other materials. The basic configuration is that of a perforated sheet or plate having supporting piers 25 and footings 26 (FIG. 3). The perforations 23 in the plate are bounded by ribs 24. Although the size of the ribs and the openings are gauged according to insulation specifications for a given roof, the openings should be as large as possible and the width of ribs 24 should be as narrow as possible. This serves to increase the exposed surface area of the insulation layer 30 and to maximize drainage of water through the grid.

The spaced piers and footings 25, 26 elevate the grid 20 from the support deck 15 or vapor barrier 17 and thus establish an air flow path in the space 28 there between. The space 28 also provides a place for water to collect out of contact with the insulation layer 30. Passage of water through flat-roof constructions is one of the significant problems overcome by the present invention. As previously discussed, in old systems, water which soaked into the insulating material had no means of escape. If evaporative conditions were insufficient, the insulation was damaged and usually had to be replaced. The ventilating grid 20 provides a means for such water to escape through the insulation into the air space 28. There the water may be allowed to collect and naturally evaporate, or may be withdrawn by a suction or vacuum applied through vent means 40 (FIG. 3).

Vents 40 are added to the grids 20 in random locations. For example, in a standard 3'×8' sheet of grid, four vents 40 might be provided. This number can, of course, vary according to prescribed specifications. The vents 40 include a lower conduit or cylindrical portion 42 having a surrounding flange 44 molded integrally with or otherwise attached to the grid 20. Flange 44 supports the base of the cylindrical portion 42. A vent cap 46 is inserted in the cylindrical portion 42 for covering but not sealing, the conduit.

Functioning of the venting means 40 is at least threefold. The first function is simply to improve air flow through the roofing system. Conventional construction of flat roof systems will allow air to enter the edges of the grid into the air passageway 28 between the layers. The air flow thus established with the vents or ducts 40 significantly improves the natural evaporative effect of the improved construction.

A second function of the vent 40 is the provision of an outlet for connecting a suction or vacuum device into the air spaces and passages 28 for withdrawal of excessive amounts of water. This function becomes important under any circumstance where an excessive amount of water enters the roofing system because of leaks, or by injection, and accumulates. Any type of appropriate suction equipment can be inserted through the vents 40, and the water withdrawn therethrough.

A third equally important function of the venting means 40 is for injection of water into the roofing system during fires. In the event of a fire breaking out in the building structure, the roofing system is sometimes a primary means of the fire spreading. Provision of means for containing the spread of fire significantly reduces damage and subsequent loss. By use of venting means 40, water is injected into passageways 28 where it will generally extinguish fires before they reach the roof membrane 35 from within the building. After the fire is extinguished and the safety of the structure established, water which was injected can be withdrawn by suction as described above.

Figure 4:
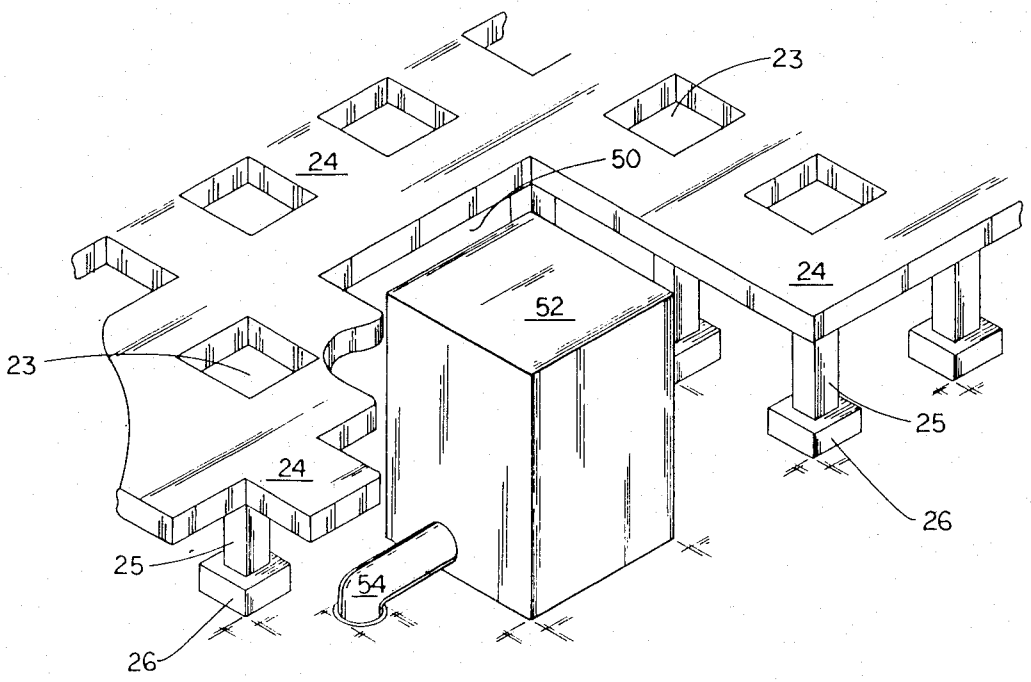
FIG. 4 is an enlarged perspective view of a portion of the grid element of FIG. 3, illustrating a related control housing.

Also shown in FIG. 3, and in more detail in FIG. 4, the grid 20 is provided optionally with a cutout 50 for insertion of a control housing 52 therethrough. The controls in housing 52 will vary according to specifications for a given installation but generally include temperature and humidity control sensors, temperature and humidity control devices, and other like mechanisms. Signal cables (not shown) for the various devices are enclosed in conduits 54 extending from the side wall of box 52 to the internal regions of the building for operative connection to the respective air treatment or other systems. With the present invention the sensor controls can now be installed within the roof construction and the data determinations made more responsive to conditions outside the building or within the roof.

Figure 5:
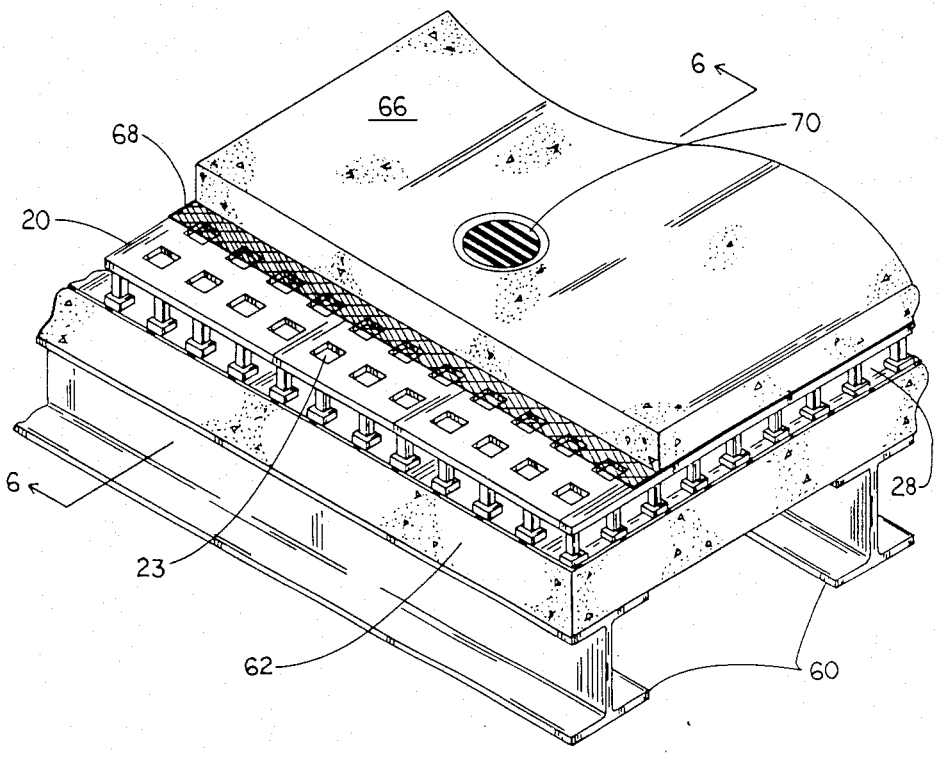
FIG. 5 is a perspective view of a portion of the roofing system illustrating an alternate embodiment of the present invention as used for constructing parking decks, terraces, etc.
Figure 6:
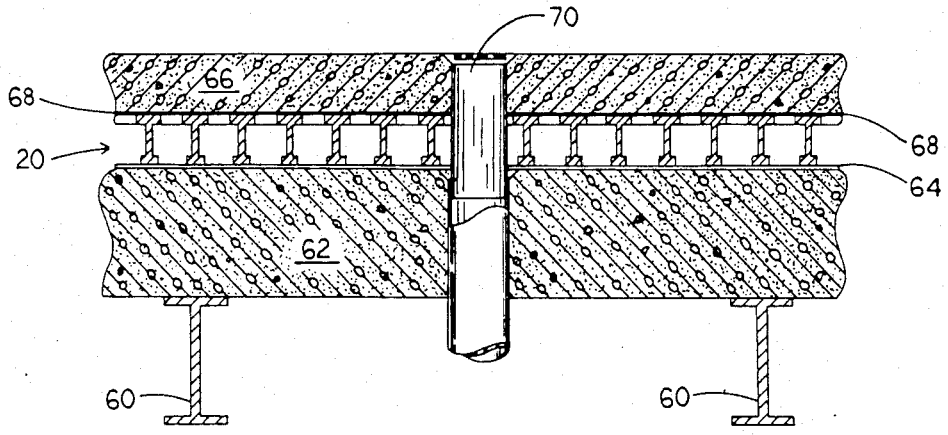
FIG. 6 is a cross-sectional view taken along line 6—6 of FIG. 5 illustrating the preferred drainage system.

The roofing system according to the description above is also applicable to other environments. The grid system is easily adaptable to use in parking decks, promenade decks, some types of floors, etc. FIG. 5 is a sectional view of a parking deck such as used on top of buildings or in multi-level parking garages. The structure is similar to that used for flat roofs in that the grid is installed intermediately of the components to create passageways for water and air. FIGS. 5 and 6 illustrate a deck structure comprising a structural steel foundation or beam 60 which supports a concrete base 62, a water proof membrane 64, the grid member 20, and the upper deck portion 66. Between the deck 66 and the grid 20, a scrim cloth 68 is inserted to prevent clogging of the grid perforations 23 when the concrete deck is poured. A scrim cloth is generally a woven or nonwoven air and water pervious sheet material used in industrial settings in a variety of ways. In the present embodiment, if the scrim cloth 68 is not used, concrete will seep into the grid perforations, harden, and defeat the purpose of the grid. When correctly installed, the scrim 68 and the grid 20 function to provide clear passageways 28 as previously described for circulation of air or water. A drain 70 is installed in the deck structure of FIGS. 5 and 6 at prescribed locations for drainage of water through the deck. With the further addition of conduit venting means (not shown in deck) such as previously described in FIG. 3, any water that collects in the grid passageways 28 can be suctioned out to prevent excessive seepage into the concrete base. The waterproof membrane 64 protects against seepage into the base, but where the membrane is damaged, or water collection is excessive, the ability to suction out is a significant advantage.

Figure 7:
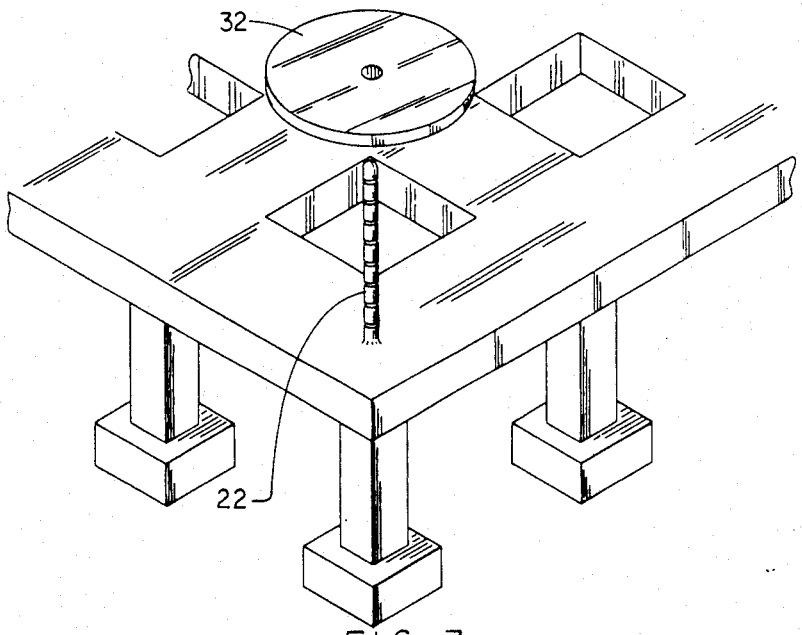
FIG. 7 is a greatly enlarged perspective view of a small portion of the grid member of FIGS. 2 and 5, illustrating the piers, footings, and insulation attachment means.

FIG. 7 is an enlarged view of the grid 20, detailing the insulation attachment barbs 21. In roofing systems, to meet building code regulations for wind lift, the insulating material 30 would have to be adhered to the grid 20 by means of adhesive or other means such as by the barbs 21. Use of the barbs 21, whereby the insulation is pushed downwardly over the barbs and a disk cap 32 snapped onto the barb over the insulation, reduces or eliminates the need for hot asphalt as an adhesive material. The elimination of asphalt significantly improves fire ratings for the building structure. Coupled with the structural grid work and venting, which allows for water to be pumped onto the system to extinguish fires, fire ratings and insurance ratings are improved to the degree that a substantial economic gain can be realized.

Other economic gains are realized by the elimination or reduction of damage to the building structure through use of preventive maintenance enabled by the present invention. By means of the installation of the various controls in housing 52 (FIG. 4), a variety of computer controlled readings can be obtained, and some functional systems can be automatically controlled. Previously, such an installation in a roof was not possible. In addition to the aforementioned controls such as thermostats and the like, smoke sensors and other fire control apparatus including sprinkler systems, alarms and the like can be installed in the grid system. These additional sensors and system controls are to be tied into connections with fire departments, plant engineering offices, etc. Primary advantages realized from the installation of such sensors in the roofing structure include actually monitoring the level of water entry, controlling HVAC loads, and obtaining early fire warnings.

Installation of the roofing or decking structure as previously described should virtually eliminate complete loss of the roofing system by fire or other damaging occurrence, and should increase the normal life span of the structure by three or four times that of conventional structures.

Other uses for the system, particularly the deck embodiment would be in flooring for gyms, health clubs, pools, commercial kitchens or other rooms such as HVAC cooling towers and air washers where there will be an occasional accumulation of water. Other structural installations are anticipated for the grid system, all of which are within the scope of the claims below.

What is claimed is:

1. A roofing construction of the type used primarily in commercial buildings wherein the building walls support a roof support deck thereon and the roof support deck is the base for installation of a flat, built-up, compositon-type roof; said roofing construction comprising:

(a) a plurality of overlying layers including a lower vapor barrier layer formed of fluid impervious material across said supporting roof deck, an intermediate layer of insulating material having a prescribed R-value, and a cover layer; said layers being arranged one on top of another in a prescribed arrangement according to building code specifications;

(b) a ventilating means interposed between two of said overlying layers for providing a substantially continuous open space for the free flow of air and/or water therebetween;

(c) said ventilating means being comprised of a rigid, perforated planar member having means for supporting said planar member contiguously to the one of said layers immcdiately above said planar member and spaced above and away from the one of said layers immediately below said planar member.

2. A roofing construction according to claim 1 wherein said ventilating means comprises:

(a) a grid member formed of a planar panel and having a plurality of openings therethrough, said openings being defined by and bound on each side by a plurality of intersecting rib members; (b) said grid member further including:

(i) said ribs being supported by a multiplicity of spaced apart, supporting piers extending downwardly from underneath said ribs; and (ii) a footing portion at the base of each pier, for supporting and stabilizing said piers atop said roof support deck;

whereby, said piers and foootings establish air space between said grid member and said roof support deck for the flow of air and/or the collection of water.

3. A roofing construction according to claim 1 wherein said ventilating means is interposed underneath said layer of insulation so that water and moisture which invades said insulation drains therethrough and collects in said ventilating means.

4. A roofing construction according to claim 1 and further including an access means for injecting or withdrawing fluid from said ventilating means by operative connection to a source of water or air under a respective positive or negative pressure.

5. A roofing construction according to claim 1 wherein said ventilating means is formed from a low density plastic material which reduces electrical conductance capacity.

6. A roofing construction according to claim 4 wherein said means for injecting or withdrawing fluid comprises a plurality of conduits spaced at random intervals in said grid and extending perpendicularly therefrom; said conduit extending through the overlying layers of the roof structure and terminating exteriorly of said roof.

7. A roofing structure according to claim 3 wherein said ventilating means includes means for attaching said layer of insulation to the top surface thereof.

* * * * *

UNITED STATES PATENT AND TRADEMARK OFFICE

CERTIFICATE OF CORRECTION

PATENT NO. : 4,674,249

DATED : June 23, 1987

INVENTOR(S) : Carveth W. Bennett, Sr.

It is certified that error appears in the above-identified patent and that said Letters Patent is hereby corrected as shown below:

On the title page under Item (19), "Bennett, Jr." should read -- Bennett, Sr. --.

Inventor should read -- Carveth W. Bennett, Sr. --.

Signed and Sealed this

Twenty-second Day of November, 1988

*Attest:*

DONALD J. QUIGG

*Attesting Officer*

*Commissioner of Patents and Trademarks*